US005273121A

United States Patent [19]

Kitney et al.

[11] Patent Number: 5,273,121

[45] Date of Patent: Dec. 28, 1993

[54] INTERCARRIER MECHANISM FOR CONNECTING AND ORIENTING TUBING CONVEYED PERFORATING GUNS

[75] Inventors: Howard R. Kitney, Singapore, Singapore; Michael J. Hudspith, Darwin, Australia

[73] Assignee: Eastern Oil Tools PTE Ltd., Singapore, Singapore

[21] Appl. No.: 862,793

[22] Filed: Apr. 3, 1992

[51] Int. Cl.[5] ..... E21B 43/116; E21B 17/02

[52] U.S. Cl. ..... 175/4.51; 166/55.1; 166/242; 285/330

[58] Field of Search ..... 175/4.51, 256, 74; 166/242, 55.1, 297; 285/330, 24, 27; 403/4

[56] References Cited

U.S. PATENT DOCUMENTS

| | | | |
|---|---|---|---|
| 1,610,414 | 12/1926 | Bernard et al. | 285/330 |
| 3,198,555 | 8/1965 | Johnson et al. | 285/330 X |
| 3,294,163 | 12/1966 | Lebourg | 175/4.51 X |
| 3,923,106 | 12/1975 | Bosse-Platiere | 166/55.1 X |
| 4,269,278 | 5/1981 | Vann | 175/4.51 |
| 4,410,051 | 10/1983 | Daniel et al. | 175/4.51 |
| 4,646,831 | 3/1987 | Marsh et al. | 166/242 |
| 4,850,438 | 7/1989 | Regalbuto | 166/55.1 X |
| 5,040,619 | 8/1991 | Jordan et al. | 175/4.51 |
| 5,107,927 | 4/1992 | Whiteley et al. | 175/4.51 X |

*Primary Examiner*—Hoang C. Dang
*Attorney, Agent, or Firm*—James L. Jackson

[57] ABSTRACT

An orienting intercarrier assembly is provided for oriented interconnection and locking of tubing conveyed perforating guns. The apparatus incorporates upper and lower intermediate adapter sections including tapered guide surfaces that correct for axial misalignment as the adapters are stabbed into sealed assembly. The adapters are also provided with alignment pins and rotational alignment guide surfaces that enable the adapters of the intercarrier assembly to be properly assembled and locked only when precise rotational orientation therebetween has been established. The apparatus also incorporates a locking mechanism enabling the adapters to be securely locked in assembly and to be retained against inadvertent disassembly. In all current embodiments for dual completion and for precision location of perforating guns within the well casing, the intercarrier assembly may be provided with orientation blocks having a specific external configuration for contact with inner surfaces of the well casing and other components therein to establish desired gun positioning relative to these components.

24 Claims, 4 Drawing Sheets

INTERCARRIER MECHANISM FOR CONNECTING AND ORIENTING TUBING CONVEYED PERFORATING GUNS

FIELD OF THE INVENTION

This invention relates generally to tubing conveyed perforating guns for perforating the well casing during completion of petroleum producing wells. More specifically, the present invention is directed to an orienting intercarrier assembly for joining and orienting two or more tubing conveyed perforating guns for accurate orientation of the perforating directions of the guns, especially for completion of deviated and horizontal wells and for dual well completions.

BACKGROUND OF THE INVENTION

Typically perforating guns for completion of petroleum producing wells are threaded together using threaded interconnection subs or blast joints, so the perforating guns are oriented together at random. This circumstance typically presents no problem when perforation is being accomplished in vertically oriented well bores for the reason that the charges or perforating elements are oriented horizontally and thus fire horizontally with the charges oriented in random manner for perforation of the well casing to establish flow of production fluid into the well casing.

A significant number of petroleum wells are being drilled and completed at this time where the well bore begins from the earth's surface with its upper portion oriented vertically. The well bore, as it extends downwardly, is then transitioned by a deviated or curved section with its lower or terminal extremity being oriented substantially horizontally and being located within a substantially horizontal petroleum bearing formation. The horizontal lower portion of the well bore can extend horizontally in a petroleum producing formation for many hundreds of feet. In such case, it is desirable to perforate the casing at many locations along a considerable portion of its terminus in the formation. Obviously, single perforating guns can be run into the well bore individually to perforate selected lengths of the well casing, with each of the perforations being oriented horizontally so as to remain well within the confines of even narrow petroleum producing zones. Individual, sequential running of perforating guns in this manner is an extremely expensive type of well completion operation. To minimize the "trips" or sequences of well perforation and to accomplish perforation of significant lengths of the lower terminus of the well bore, it is desirable to run multiple interconnected or spaced perforating guns and to fire them simultaneously. Well completion of this manner, however, may require precise orientation of multiple perforating guns because of the requirement for controlled directional firing or shooting. It is desirable, therefore, to provide a means for achieving accurately controlled orientation of multiple perforating guns to thereby enable simultaneous perforation of considerable lengths of well casing in the horizontal portions of well bores.

Controlled directional firing or shooting is important when perforating for a dual completion, when the gun is run in next to the long string blast joint, and the shots must be oriented away from the long string and toward and in close proximity with the well casing. In the alternative, when perforating the casing of a horizontal well, the direction of shooting or firing may need to be restricted solely to horizontal firing, to avoid a water producing zone located above or below the hydrocarbon zone. It is desirable, therefore, to provide a mechanism for achieving accurate orientation of tubing conveyed perforating guns so as to precisely insure that the perforation shots will be oriented with a high degree of directional accuracy.

Most standard tubing conveyed perforating guns are provided with an orienting slot machined on the inside, to orient the loading tube inside the gun. The loading tube carries the perforation charges, so the position of the indexing slot fixes the position of the charge, and thereby, the direction of the perforation that is capable of being achieved upon firing of the gun. When multiple tubing conveyed perforating guns are employed simultaneously, it is desirable to achieve precision orientation of each of the guns relative to the tubing string and with respect to one another. When all of the perforating guns are oriented with a high degree of precision, then the direction of firing of each of the guns can be accurately controlled and thus each of the perforation shots being fired will be oriented specifically with respect to the petroleum bearing formation being completed for production.

SUMMARY OF THE INVENTION

It is therefore a principle feature of the present invention to provide a novel orienting intercarrier assembly for tubing conveyed perforating guns having the capability of both interconnecting and precisely orienting adjacent tubing conveyed perforating guns so that the perforating shots thereof downhole can be accurately oriented with respect to the production formation and with respect to the well casing and other well casing components such as long string blast joints for dual completion.

It is also a feature of the present invention to provide a novel orienting intercarrier assembly for tubing conveyed perforating guns which enables simple and efficient interconnection and orienting thereof.

It is another feature of this invention to provide a novel orienting intercarrier assembly for connecting and aligning perforating guns and which employs a locking mechanism that prevents inadvertent disassembly thereof in the downhole environment.

Briefly, the various features of the present invention are realized through the provision of an orienting intercarrier assembly for tubing conveyed perforating guns which accomplishes transfer of gun orientation from one gun to the next to thus enable any desirable number of perforating guns to be interconnected end-to-end with each of them being accurately oriented with respect to the other and with all of the perforating guns being accurately oriented with respect to the tubing string or blast joint that is employed for positioning thereof at the formation level.

Each perforating gun for use in connection with the intercarrier assembly of this invention is provided with an orienting slot milled or otherwise formed precisely in line with, and for horizontal shooting, opposite to the indexing slot. When the lower intermediate adapter is threaded into the gun, it extends into the gun far enough so that the slots in the gun align with drilled and tapped holes in the intercarrier assembly. Screws or other locating elements are inserted into the tapped holes to thereby lock the lower intermediate adapter with respect to one of the perforating guns. The intercarrier assembly also incorporates an upper intermediate adapter that is threaded into and locked in relation with the upper end of the next perforating gun in the same manner. The upper intermediate adapter of the intercarrier assembly is provided with a locking sleeve in the form of a collar nut, which is assembled to the adapter in such manner that it is free to move up and down within a peripheral groove, but is trapped in the groove. Normally, gravity will maintain this collar in the down position, where its upper portion is aligned with the upper end of the upper intermediate adapter insuring that its threads are protected. Inside, the upper intermediate adapter is machined to define a seal surface, a tapered bore and two receptacles for alignment or indexing pins.

The lower intermediate adapter of the intercarrier assembly is provided with an elongate reduced diameter, tapered nose which is adapted to stab into and intimately fit within the tapered bore of the upper intermediate bore, and to protect the explosive booster that is positioned within a central passage that is cooperatively defined by the upper and lower intermediate adapters. The coupling projection or nose of the upper intermediate adapter is tapered to compensate for any slight misalignment that might initially exist between the upper and lower intermediate adapters, thus allowing the tapered nose to stab in easily without necessarily having to be exactly vertical. Two spaced indexing slots are provided in the lower intermediate adapter to accept the orienting or indexing pins from the upper intermediate adapter and thus position the adapters in rotationally aligned relation. The tapered coupling projection is provided with spaced seal grooves which receive sealing members that enable the adapter assembly to withstand external pressure and protect the detonation assembly from fluid contamination.

The upper and lower intercarrier adapters and therefore the two adjacent perforating guns, must be in line to stab in, but any slight rotational misalignment thereof will be corrected by the lead in taper of the indexing slots. If the alignment is correct, the upper and lower adapter subs will come together smoothly into interengaged and sealed assembly. If the alignment is not correct, fully assembled and locked interconnection between the upper and lower adapter subs will be impossible. Thus, the intercarrier system can not be interconnected improperly and is thus "fool-proof".

Alternative embodiments of this invention enable its efficient utilization for assured orientation in dual completions and assured orientation in horizontal completions. These features are achieved simply by replacement of the split looking ring of the intercarrier assembly with split locking rings that are appropriately externally configured to form orientation blocks for the type of completion, i.e., dual or horizontal, that is to be accomplished.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
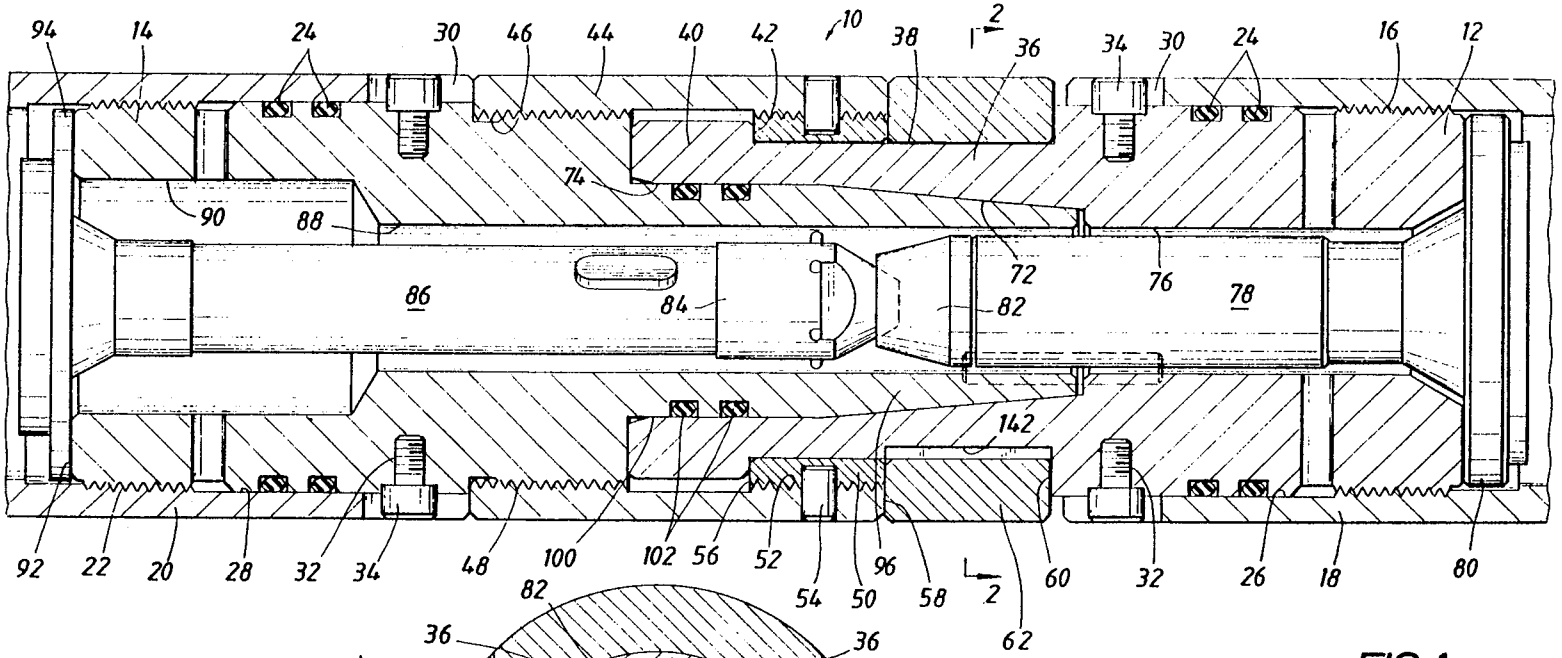

FIG. 1 is a sectional view of an orienting intercarrier assembly constructed in accordance with the present invention and being shown in its assembled and locked condition and in orienting assembly with adjacent tubing conveyed perforating guns.

Figure 2:
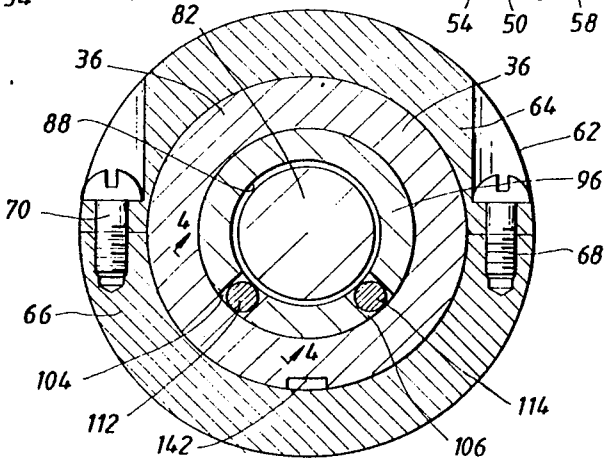

FIG. 2 is a sectional view taken along line 2—2 of FIG. 1.

Figure 3:
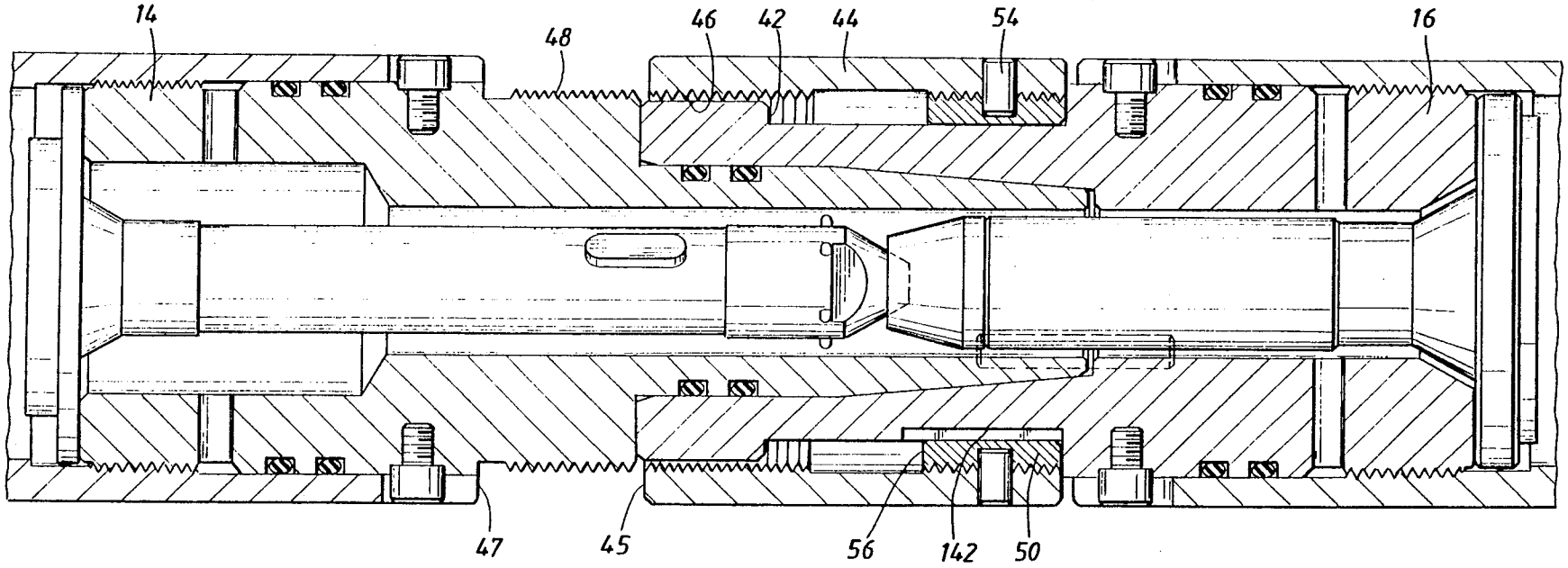

FIG. 3 is a sectional view of the orienting intercarrier assembly of FIG. 1, being shown in its assembled but unlocked condition.

Figure 4:
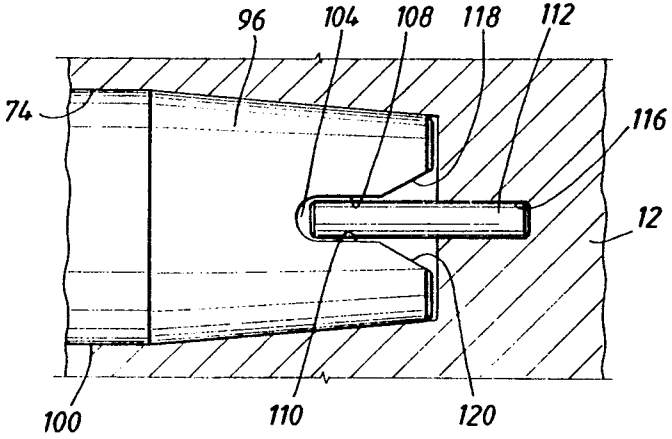

FIG. 4 is a fragmentary sectional view of the intercarrier assembly of FIGS. 1-3 being taken along line 4—4 of FIG. 2 and illustrating the relationship of one of the orienting pins thereof with the upper and lower adapter subs.

Figure 5:
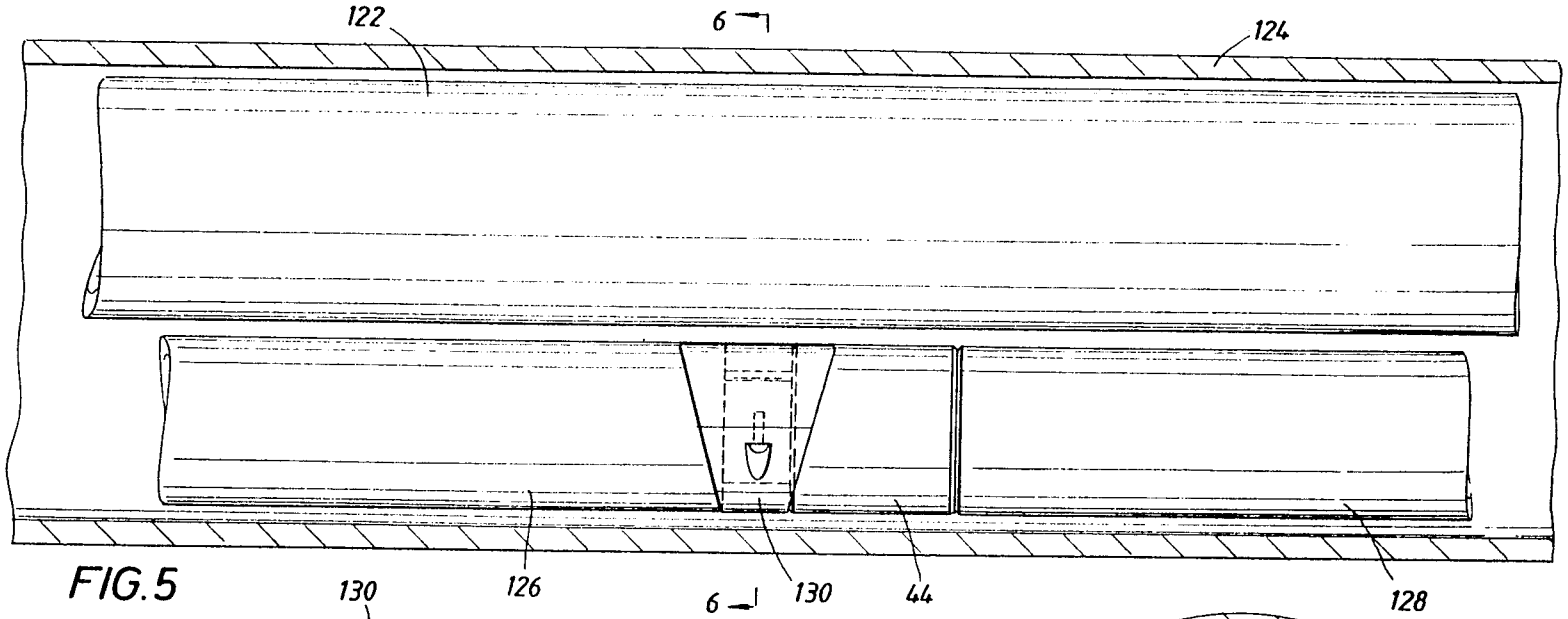

FIG. 5 represents an alternative embodiment of this invention incorporating, together with the structure of FIG. 3, an orientation block for achieving proper positioning of adjacent tubing conveyed perforating guns relative to the well casing and a long string blast joint that positions other perforating guns at the level of a lower production formation.

Figure 6:
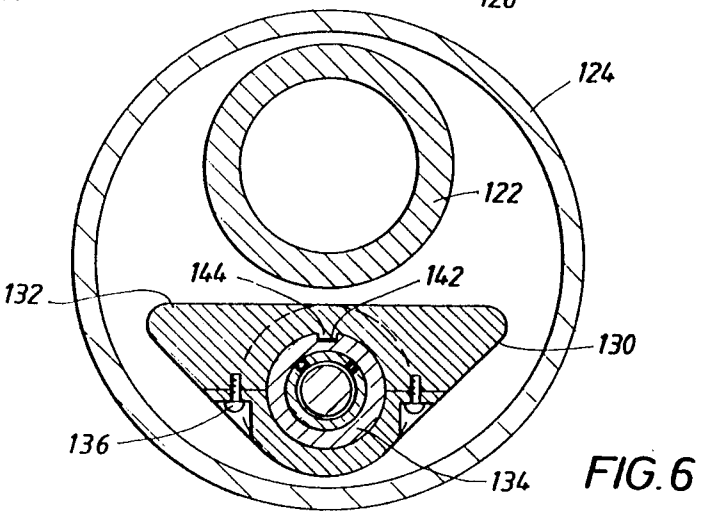

FIG. 6 is a sectional view taken along line 6—6 of FIG. 5.

Figure 7:
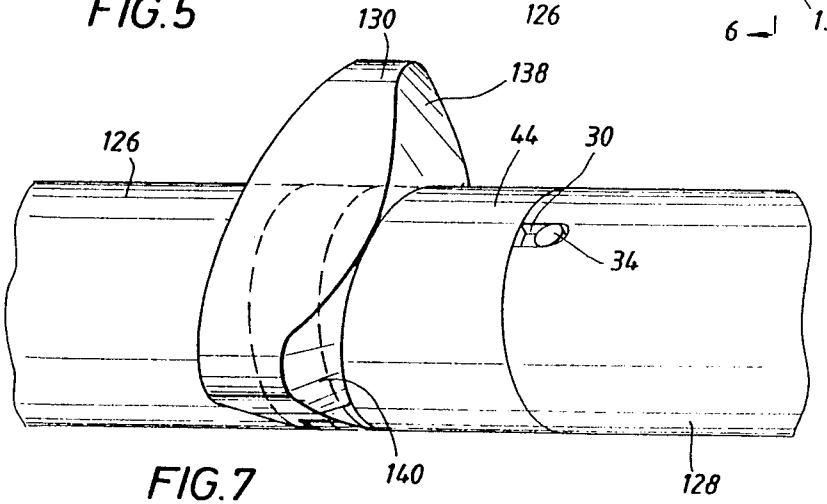

FIG. 7 is an isometric illustration showing the relationship of the orientation block in relation to the intercarrier assembly and upper and lower perforating guns.

Figure 8:
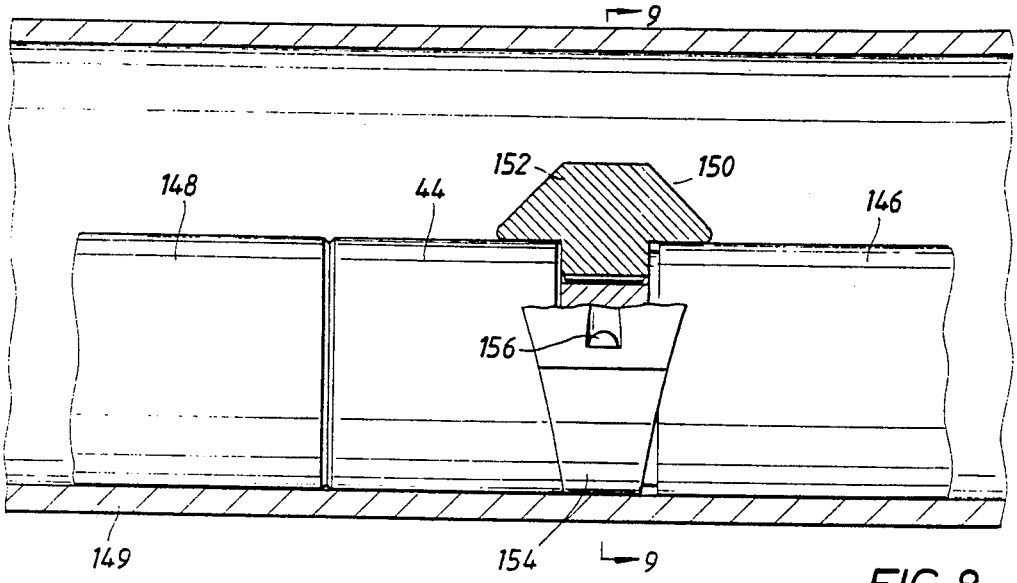

FIG. 8 represents a sectional view taken through well casing and illustrating by way of elevation and partial section, a further alternative embodiment of this invention incorporating the basic intercarrier structure of FIG. 3 together with an orientation block of alternative design for achieving desired positioning of the perforating gun relative to the well casing.

Figure 9:
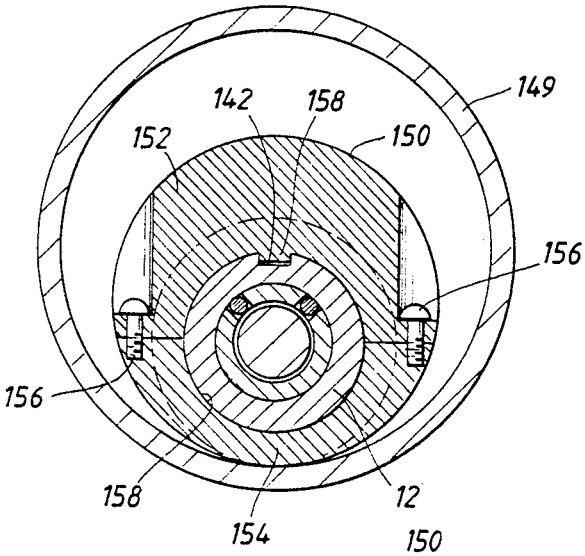

FIG. 9 is a sectional view taken along line 9—9 of FIG. 8.

Figure 10:
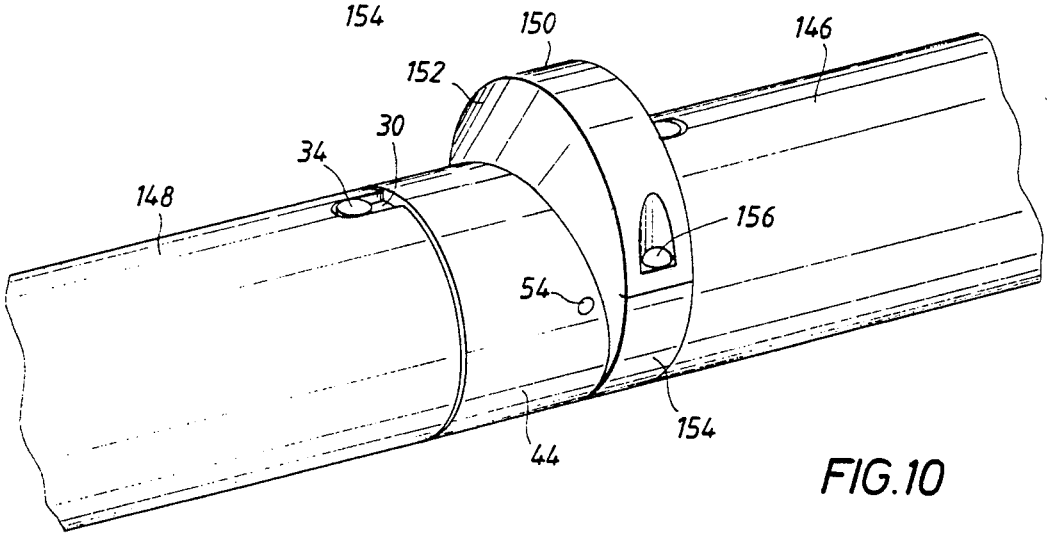

FIG. 10 is an isometric illustration of upper and lower perforating guns being interconnected and oriented by the intercarrier assembly of FIGS. 3, 8 and 9.

DETAILED DESCRIPTION OF PREFERRED EMBODIMENT

Referring now to the drawings and first to FIGS. 1-3 an orienting intercarrier assembly constructed in accordance with the present invention is illustrated generally at 10 and incorporates interengaging upper and lower intermediate adapter subs or sections 12 and 14. Intermediate adapter section 12 is also referred to herein as the "upper adapter section" while intermediate adapter section 14 is referred to herein as the "lower adapter section". Such is not to be considered limiting of this invention, however. The intercarrier assembly may be inverted without departing from the spirit and scope of this invention. The upper adapter section 12 is basically in the form of a machined body defining an upper externally threaded section 16 adapted to receive corresponding internal threads at the lower end of a perforating gun 18. It should be born in mind that tubular element 18 may comprise a lower portion of a perforating gun, or in the alternative, may comprise the lower end of a spacer sub that is interconnected and oriented with respect to a perforating gun. Spacer subs, where employed, enable desired spacing of adjacent perforating guns to thereby permit simultaneous perforation of the well casing at desired locations. Likewise, the tubular element 20 of the lower perforating gun may comprise a spacer sub having an internal threaded section to receive the lower externally threaded section 22 of the lower intermediate adapter 14. The upper and lower adapters each carry circular sealing elements such as O-ring seals 24 within circular, spaced circular seal grooves for establishment of sealing engagement with respective internal cylindrical sealing surfaces 26 and 28 of the respective tubular perforating gun extremities 18 and 20 to thus prevent fluid pressure externally of the perforating guns from entering through the intercarrier assembly.

The respective tubular extremities 18 and 20 of the perforating guns each define opposed locator slots or openings 30 that are capable of being positioned in registry with internally threaded alignment holes 32. Cap screws or other locator devices 34 are received by the threaded holes 32 and define positioning heads or surfaces that are intended for location in the respective orienting slots 30. In this manner the respective upper and lower perforating guns or their respective spacer subs are capable of being precisely oriented with respect to the upper and lower intermediate adapter sections 12 and 14 of the intercarrier assembly.

The upper intermediate adapter section 12 defines a locking extension 36 forming a reduced diameter external surface 38 and a terminal enlargement 40 defining an external locking shoulder 42. A locking sleeve 44 having an internally threaded lower end 46 is adapted to be threadedly received by an externally threaded section 48 of the lower adapter section 14. The locking sleeve 44, which is also referred to as a locking nut, is positionable at a fully locked position as shown in FIG. 1, and an unlocked position as shown in FIG. 3.

An externally threaded split ring 50 is received by an upper internally threaded section 52 of the locking sleeve 44 and is secured against rotation by retainer pins 54 that are received by respective aligned bores of the locking ring 44 in the split ring 50. If desired, the retainer pins 54 may be press fitted within the respective aligned bores to prevent inadvertent disassembly thereof from the intercarrier assembly. The split ring 50 forms a downwardly directed thrust shoulder 56 which is disposed for engagement with the locking shoulder 42. Thus, as the locking ring 44 is threaded onto the threaded section 48 of the lower adapter section. The thrust shoulder 56 will force the locking shoulder 42 downwardly, thus drawing the upper adapter section 12 into fully seated relationship with the lower adapter section.

After the locking ring 44 has been fully threaded onto the lower adapter section 14, a circular space defined by cylindrical surface 38 and opposed shoulder surfaces 58 and 60 will be defined. To positively insure against unthreading of the locking sleeve 44 from the lower adapter section, a split locking ring 62 including locking ring sections 64 and 66, as shown in FIG. 2 is utilized to fill the circular space. The locking ring sections 64 and 66 are secured in assembly by means of screws or bolts 68 and 70 in the manner shown in FIG. 2. To unlock the orienting intercarrier assembly and allow separation of the perforation guns, the semicircular segments 64 and 66 of the locking ring 62 are separated by removal of the screws 68 and 70. After the locking ring 62 is removed from its circular space the locking sleeve 44 may be unthreaded, backing the thrust shoulder 56 away from the locking shoulder 42.

The upper adapter section 12 is formed internally to define a tapered orienting receptacle having a tapered or frusto-conical surface portion 72 and a cylindrical surface portion 74. This tapered receptacle is disposed in axially aligned relation with a passage 76 which is adapted to receive a detonation extension 78. The detonation extension projects from an alignment plate 80 which is a component of the intercarrier detonation assembly for controlled simultaneous firing of the adjacent perforating guns. The detonation assembly also includes a transfer housing 82 which is positioned in assembly with a detonation booster 84 that is carried at the inner extremity of another detonation extension 86. The detonation extension 76 is received within an internal passage 88 that is formed in the lower adapter section 14 and which is in registry with an enlarged axial passage section 90. The lower end of the adapter section 14 defines an abutment surface 92 that is disposed for supporting engagement with an alignment plate 94 of the explosive booster system that extends through the intercarrier assembly.

For establishment of proper alignment between the upper and lower intermediate adapter sections, the lower adapter section 14 is provided with an axially extending upwardly directed tapered projection 96 having a frusto-conical or tapered external surface 98 and a cylindrical external surface 100. A pair of circular sealing elements 102 such as O-ring seals are retained within circular external grooves formed in the projection 96 and serve to establish a positive fluid tight seal between the opposed cylindrical sealing surfaces 74 and 100 to prevent pressurized fluid externally of the intercarrier assembly from entering and contaminating the perforating gun mechanism. The taper of the projection 96 and the corresponding taper of the tapered internal receptacle of the upper adapter section 12 have a guiding or centering function during axial assembly of the adapters to correct for slight rotational or vertical misalignment during assembly. This feature permits the upper and lower adapters to come together easily and to move into proper aligned and mating engagement even under circumstances where these components are axially misaligned or radially misaligned as the assembly and locking procedure is initiated. The corresponding tapered surfaces 72 and 98 permit the adapters to be guided from a misaligned relation to a properly oriented and aligned relation as the adapters are "stabbed" into assembly.

To enable precise alignment of the upper and lower adapters 12 and 14 from the standpoint of rotation, the tapered projection or stabbing nose 96 of the lower adapter 14 defines at least one and preferably a pair of spaced alignment receptacles as shown at 104 nd 106 in FIG. 2 which are shown to have an angular relationship of about 90° between them. This particular angular relationship however is not intended to be limiting since any desired angular relationship or number of alignment receptacles may be employed without departing from the spirit and scope of this invention. As shown particularly in FIG. 4, each of the alignment receptacles defines opposed, parallel alignment surfaces 108 and 110 for establishment of close fitting, aligning relationship with respect to a pair of alignment pins 112 and 114 which are received within respective pin supporting bores 116 of the upper intermediate adapter 12. Preferably, the alignment pins 112 are press fitted within the respective bores 116, although they may be supported therein in any suitable manner.

The alignment receptacles each define opposed angulated guide surfaces 118 and 120 which define a "lead-in" taper to establish a camming relationship with the ends of the respective alignment pins 112 and 114 upon stabbing assembly of the upper and lower intermediate adapters. This camming activity induces relative rotation of the adapters 12 and 14 such that the alignment pins 112 and 114 will enter and become seated within entering the receptacles 104 and 106. The opposed alignment surfaces 108 and 110 of the alignment receptacles establish a close fitting relationship with the respective alignment pins such that virtually no rotational misalignment between the upper and lower adapters will exist when these components become fully assembled. The opposed tapered guide or cam surfaces 118 and 120 insure ease of stabbing the adapters into precisely oriented interrelation. If the adapters are grossly misaligned, the respective ends of the alignment pins will contact the circular end surface of the coupling projection 96 thereby stopping axial assembly movement of these components. In this condition, the locking sleeve 44 is restrained from threaded engagement with threads 48 of the lower intermediate adapter 14. Improper assembly of the upper and lower adapters is therefore impossible. If a grossly misaligned relationship between the alignment pins and alignment receptacles is evident the upper and lower adapters are simply rotated one with respect to the other sufficiently to bring the ends of the alignment pins into engagement with one of the tapered cam surfaces 118 or 120. As mentioned above, after the upper and lower adapters have been stabbed together fully as shown in FIG. 3, the locking sleeve, which will then be in the position shown in FIG. 3, is simply rotated causing the threads 46 and 48 to make up until the lower end 45 of the locking sleeve has established abutting relation with the upwardly facing stop shoulder 47. Thereafter, the locking ring 62 is assembled in the manner discussed above, thus filling the space between shoulders 58 and 60 and preventing the locking sleeve 44 from becoming inadvertently unthreaded.

As mentioned above, for dual completions of petroleum wells and to establish a desired relationship between the perforating guns and the well casing for efficient casing perforation, the basic orienting intercarrier assembly of FIGS. 1-3 may be provided with orientation blocks or devices which are substituted for the locking ring 62. As shown in FIGS. 5-7 an orientation block 130 is employed to establish a desired relationship between a pair of interconnected perforating guns and a long string blast joint that extends to a lower level in the well casing for perforation of a lower production zone. As shown particularly in FIG. 5, a long string blast joint 122 extends downwardly through well casing 124 and thus positions one or more perforating guns at a desired lower level within the well casing, in registry with a lower production zone intended to be completed and produced. Ordinarily, the position of the long string blast joint will be at random within the well casing. As further shown in FIG. 5, upper and lower perforating guns 126 and 128 are shown to be located within the well casing 124 and are also shown to be interconnected and oriented by the basic intercarrier assembly of FIGS. 1-3. In place of the conventional locking ring 62 of FIGS. 1-3 an orientation block 130 functions as a locking element to prevent inadvertent unlocking of the intercarrier assembly and also functions to establish a desired oriented relationship between the long string blast joint 122 and the well casing 124 so that the charges of the perforating guns are directed to the well casing and away from the long string blast joint. As shown particularly in FIG. 6 and in the isometric illustration of FIG. 7, the orientation block 130 is of split configuration defining block sections 132 and 134 that are secured in assembly by means of screws or bolts 136. The orientation block 130 is of generally triangular configuration defining opposed projecting wings 138 and 140 which are precisely oriented with respect to the intercarrier assembly and which are disposed with engagement with the inner surface of the well casing or with the long string blast joint to insure precision location of the intercarrier assembly and thus the upper and lower perforating guns 126 and 128 for efficient perforation of the casing. For orientation of the orientation block relative to the intercarrier assembly, the upper adapter section 16 defines an external keyway or recess 142 as shown in FIGS. 1, 3 and 6 which is disposed to receive an orienting key 144 provided internally of orientation block section 132. Thus, with the key 144 located within the alignment keyway 142, the orientation block 130 will be precisely oriented with respect to the intercarrier assembly.

It should be noted with respect to FIG. 5 that the intercarrier assembly, with its orientation block is inverted as compared to FIGS. 1 and 3. Thus it should be understood that identification of adapters 12 and 14 as "upper and lower" adapters respectively does not limit orientation of these components in this manner. The intercarrier assembly is capable of assuming reverse orientation within the well casing if desired by the user, without departing from the spirit and scope of this invention.

Referring now to FIGS. 8-10, another alternative embodiment of the present invention is illustrated which again, employs the basic structure of the intercarrier assembly, but utilizes an alternative orientation element in place of the locking ring 62. As shown in FIG. 8, upper and lower perforating guns 146 and 148 are shown to be interconnected by the intercarrier assembly of FIGS. 1 and 3 and located within well casing 149. A split orientation block 150 having orientation block sections 152 and 154 are shown to be interconnected by means of bolts or screws 156. An internal key member 158 of the orientation block section 152 is shown to be received in aligning relationship with the keyway 142 of the upper intermediate adapter 12 thus aligning the orientation block with respect to the intercarrier assembly and with respect to the upper and lower perforating guns. The orientation block 150 is of substantially circular configuration and when assembled to the intercarrier assembly, has its external circular surface disposed in eccentric relation with the upper adapter 12 of the intercarrier assembly. This occurs because the inner circular opening 158 defined by the assembled orientation block is disposed in eccentric relation with the outer circular surface of the orientation block.

The orientation block 150 insures positioning of the intercarrier assembly and thus the upper and lower perforating guns with the firing sides of the perforating guns oriented in close proximity with the inner surface of the well casing so that efficient, directionally oriented firing of the perforation charges will occur to establish efficient properly oriented perforations of the well casing at the production formation level. Since perforation of the casing virtually always achieves penetration into the production formation, whether shaped charges or explosive projectiles are used, the perforations will be properly oriented with respect to the production formation.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. An orienting intercarrier assembly for orienting and interconnecting tubing conveyed perforating guns for perforating well casing during well completion operations and having an indexing slot at the end thereof comprising:

(a) a first adapter section having indexing means at one end thereof for oriented engagement within said indexing slot of a tubing conveyed perforating gun, said first adapter section forming an axially extending coupling projection and forming an axial passage for receiving an explosive booster, said coupling projection forming at least one alignment receptacle means;

(b) a second adapter section having indexing means for oriented attachment to an adjacent perforating gun, said second adapter section forming a coupling receptacle for receiving said coupling projection in close fitting relation therein and forming an axial passage for registry with said axial passage of said first adapter section, said second adapter section further having alignment means for aligning registry with said alignment receptacle of said first adapter section; and (c) means for locking said first and second adapter sections in oriented assembly.

2. The orienting intercarrier assembly of claim 1, wherein:

(a) said alignment means being defined by guide means of said second adapter section and guide projection means of said first adapter section which cooperatively interact to achieve rotational orientation of said first and second adapter sections for thus correcting rotational misalignment of said first and second adapter sections during linear movement thereof into interfitting assembly.

3. The orienting intercarrier assembly of claim 2, wherein said alignment means comprises:

(a) at least one alignment slot being formed by said first adapter section and opening toward said second adapter section; and (b) at least one alignment pin projecting from said second adapter section and being received in aligning relation by said alignment slot upon said interfitting assembly of said first and second adapter sections.

4. The orienting intercarrier assembly of claim 3, wherein said alignment slot defines:

(a) a pair of opposed, generally parallel side surfaces; and (b) a pair of oppositely angulated guide surfaces extending from respective side surfaces to one end of said first adapter section.

5. The orienting intercarrier assembly of claim 1, wherein:

(a) said first adapter section forms an elongate coupling projection defining a pair of open ended alignment slots being disposed in substantially parallel relation, each of said alignment slots having opposed, generally parallel alignment surfaces defining inner portions thereof and having diverging guide surfaces forming the outer flared portions thereof; and (b) a pair of spaced, generally parallel guide pins projecting from said second adapter section and being receivable respectively in orienting relation within said alignment slots, upon movement of said first and second adapter sections toward one another said diverging guide surfaces being contacted by said guide pins in the event of rotational misalignment of said first and second adapter sections thus inducing rotational guiding movement of said alignment pins and said second adapter section to achieve precise registry thereof with said generally parallel alignment surfaces.

6. The orienting intercarrier assembly of claim 5, wherein:

(a) said axially extending coupling projection having a free extremity and defining a frusto-conical guiding portion having its smallest dimension at said free extremity thereof; and (b) said coupling receptacle being of frusto-conical configuration along the length thereof and being of a dimension for establishing a close fitting mating and aligning relation with said axially extending coupling projection.

7. The orienting intercarrier assembly of claim 5, including:

seal means establishing a seal between said axially extending coupling projection and a surface of said coupling receptacle.

8. The orienting intercarrier assembly of claim 1, wherein said means for locking comprises:

a locking sleeve being in assembly with one of said first and second adapter sections and adapted for threaded locking engagement with the other of said first and second adapter sections.

9. The orienting intercarrier assembly of claim 1, including:

an orientation element projecting externally of said orienting intercarrier assembly and being disposed for perforating gun orienting engagement with said well casing and tubular elements within said well casing to selectively position said orienting intercarrier assembly and the perforating guns interconnected thereby in position for directionally controlled firing of said perforating guns.

10. The orienting intercarrier assembly of claim 1, including:

locking retainer means adapted for assembly with said orienting intercarrier assembly and preventing unlocking movement of said means for locking.

11. The orienting intercarrier assembly of claim 10, wherein said locking retainer means comprises:

a pair of retainer segments adapted to be assembled about one of said first and second adapter sections to form a stop element preventing said unlocking movement of said means for locking.

12. The orienting intercarrier assembly of claim 11, wherein:

said locking retainer means also defines an orientation element for engaging said well casing and any tubular element located thereon and positioning said orienting intercarrier assembly and the perforating guns interconnected thereby in position for directionally controlled firing of said perforating guns.

13. The orienting intercarrier assembly of claim 1, including:

(a) a pair of alignment pins projecting from said second adapter section; and (b) said alignment receptacle means of said coupling projection being a pair of spaced open ended alignment slots, each being oriented for receiving one of said alignment pins longitudinally therein during relative axial movement of said first and second adapter sections into interengaged assembly.

14. The orienting intercarrier assembly of claim 13, wherein:

said alignment slots each defining diverging guide surfaces for guiding said alignment pins axially and rotationally into said alignment receptacles upon axial assembly of said first and second adapter sections.

15. The orienting intercarrier assembly of claim 1, wherein:

(a) said coupling projection and said coupling receptacle are of mating tapered configuration, thus permitting relative axial movement of said first and second adapter sections into fully seated assembly; and (b) seal means establishing a seal between said coupling projection and coupling receptacle, thus preventing leakage between said first and said second adapter sections.

16. The orienting intercarrier assembly of claim 1, said means for locking comprises:

(a) stop means being defined by said first adapter section;

(b) thrust shoulder means being defined by said second adapter section; and (c) a locking sleeve adapted for threaded driving engagement with said first adapter section and having driving engagement with said thrust shoulder for securing said second adapter section against said stop shoulder.

17. The orienting intercarrier assembly of claim 16, wherein:

(a) said second adapter section forming an external peripheral recess and defining a thrust shoulder; and (b) a pair of internal thrust segments being provided by said locking sleeve and being received within said external peripheral recess, said internal thrust segments forming locking shoulders for locking engagement.

18. The orienting intercarrier assembly of claim 17, including:

(a) a segmented blocking ring being positioned in said external peripheral recess at the locked position of said locking sleeve for securing said unlooking sleeve against inadvertent locking movement; and (b) means securing said segments of said segmented locking ring in releasably assembly.

19. The orienting intercarrier assembly of claim 17, wherein:

(a) said second adapter section is formed to define a keyway located within said external peripheral recess; and (b) said means for locking comprising a segmented orientation block being positioned within said external peripheral recess and defining an internal key being receivable within said keyway thus positioning said orientation block in oriented relation with said first and second adapter segments.

20. The orienting intercarrier assembly of claim 19, wherein:

said segmented orientation block is of generally triangular external form and defines a generally circular internal opening establishing close interfitting relation about said second adapter section at said external peripheral recess.

21. The orienting intercarrier assembly of claim 20, wherein:

said orientation block comprises two segments being releasably secured in assembly about said second adapter section.

22. An orienting intercarrier assembly for orienting and interconnecting tubing conveyed perforating guns for perforating well casing during well completion operations and having an indexing slot at the end thereof comprising:

(a) a first adapter section adapted for indexed assembly with a perforating gun and having a detonation passage extending axially therethrough for receiving an explosive coupling for inducing simultaneous firing of adjacent perforating guns, said first adapter section further forming an elongate externally tapered projection extending from one end thereof and surrounding said detonation passage and forming at least one open ended rotational alignment slot;

(b) a second adapter section adapted for indexed assembly with an adjacent perforating gun and forming a detonation passage extending axially thereof and being disposed for aligned registry with said detonation passage of said first adapter section, said second adapter section further forming an internally tapered receptacle for receiving said externally tapered projection in aligning relation therein;

(c) seal means establishing a sealed relationship between said first and second adapter sections upon assembly thereof;

(d) at least one rotational alignment element projecting from said second adapter section and adapted for rotational aligning assembly within said open ended alignment slot for precise rotational alignment of said first and second adapter sections during assembly thereof;

(e) a locking sleeve being supported about said second adapter section and adapted for locking engagement with said first adapter section when said rotational alignment element is located within said open ended rotational alignment slot; and (f) lock retainer means adapted for locking assembly with said second adapter section for preventing inadvertent unlocking movement of said locking sleeve.

23. The orienting intercarrier assembly of claim 22, wherein:

said lock retainer means forming an externally projecting orientation block for orienting said intercarrier assembly and the perforating guns interconnected thereby with respect to said well casing for directionally controlled firing of said perforating guns.

24. The orienting intercarrier assembly of claim 23, wherein:

said orientation block is of a configuration for orienting engagement with a tubular element located within said well casing such that said perforating guns fire directionally away from said tubular element.

* * * * *